US010745196B2

(12) United States Patent
Staley

(10) Patent No.: US 10,745,196 B2
(45) Date of Patent: Aug. 18, 2020

(54) STORAGE HOUSING FOR A WASTE RECEPTACLE

(76) Inventor: Nicholas Staley, Wokingham (GB)

( * ) Notice: Subject to any disclaimer, the term of this patent is extended or adjusted under 35 U.S.C. 154(b) by 0 days.

(21) Appl. No.: 13/820,990

(22) PCT Filed: Aug. 19, 2011

(86) PCT No.: PCT/GB2011/051573

§ 371 (c)(1),
(2), (4) Date: Mar. 5, 2013

(87) PCT Pub. No.: WO2012/032322

PCT Pub. Date: Mar. 15, 2012

(65) Prior Publication Data

US 2013/0162119 A1 Jun. 27, 2013

(30) Foreign Application Priority Data

Sep. 6, 2010 (GB) ..... 1014759.3

(51) Int. Cl.
*B65F 1/14* (2006.01)
*B65F 7/00* (2006.01)
*B65F 1/16* (2006.01)

(52) U.S. Cl.
CPC ..... *B65F 1/141* (2013.01); *B65F 1/1426* (2013.01); *B65F 1/1623* (2013.01); *B65F 7/00* (2013.01);

(Continued)

(58) Field of Classification Search
CPC ..... B65F 1/1436; B65F 1/006; B65F 2001/1653; B65F 1/1431; B65F 1/1447; B65F 1/1426

(Continued)

(56) References Cited

U.S. PATENT DOCUMENTS 586,646 A * 7/1897 Wiederhseim ..... 229/116.1
814,563 A * 3/1906 Pond ..... 220/476

(Continued)

FOREIGN PATENT DOCUMENTS

CA 2510372 A1 1/2007
CA 2535520 A1 8/2007

(Continued)

OTHER PUBLICATIONS

ISA/EPO, PCT International Search Report, Application No. PCT/GB2011/051573, dated Aug. 19, 2011, 5 pages.

(Continued)

*Primary Examiner* — Jeffrey R Allen
(74) *Attorney, Agent, or Firm* — Kang S. Lim

(57) ABSTRACT

A storage housing (10) for a waste receptacle (11) is disclosed. The housing comprises a base (12) and side walls (13*a-d*) which extend from the base (12), and which terminate at an upper periphery (14) thereof. At least one of the side walls (13*a*) comprise a door (21) which can be opened and closed to enable the waste receptacle (11) to be removably positioned within the housing (10) through the at least one side wall (13*a*). The housing (10) further comprises locking means for releasably locking the door (21) when closed and a lid (16) which is moveable with respect to the side walls (13*a-d*) between a first position in which it substantially closes the housing (10) and a second position in which it substantially opens the housing (10) to enable waste to be deposited in the waste receptacle (11).

16 Claims, 4 Drawing Sheets

(52) U.S. Cl.
CPC ... *B65F 2210/132* (2013.01); *B65F 2210/148* (2013.01); *B65F 2210/168* (2013.01); *B65F 2230/135* (2013.01)

(58) Field of Classification Search
USPC ..... 220/908; 47/65.5, 66.6
See application file for complete search history.

(56) References Cited

U.S. PATENT DOCUMENTS 939,721 A * 11/1909 Lewis ..... 217/10
1,092,752 A 4/1914 Segall
1,109,873 A * 9/1914 Schoen ..... 217/62
2,233,796 A * 3/1941 Pines ..... 248/128
2,558,939 A * 7/1951 Dornbush ..... 312/321.5
2,924,377 A * 2/1960 Lewis ..... 232/43.2
3,014,684 A * 12/1961 Gould, Jr. ..... 248/313
3,378,323 A * 4/1968 Goldberg ..... B65F 1/1426 211/83
3,402,848 A * 9/1968 Busey ..... 220/495.08
3,434,625 A * 3/1969 Embry, Jr. ..... 220/495.06
3,602,568 A * 8/1971 Bernhardsson ..... 312/274
3,618,814 A * 11/1971 Nagroski ..... 220/804
3,647,102 A * 3/1972 Cooley ..... 220/495.08
3,659,778 A * 5/1972 Saultz ..... B65F 1/1426 16/374
3,888,406 A * 6/1975 Nippes ..... 206/554
3,922,046 A * 11/1975 Schneider ..... 312/211
3,984,941 A * 10/1976 Chetta, Jr. ..... 47/41.01
3,990,179 A * 11/1976 Johnson et al. ..... 47/67
4,577,778 A * 3/1986 Kim ..... 220/495.07
4,585,138 A * 4/1986 Jonkers ..... 220/615
4,809,850 A * 3/1989 Laible et al. ..... 206/366
4,878,590 A * 11/1989 Porter ..... 220/890
4,917,254 A * 4/1990 Ciriacks ..... 220/666
4,963,175 A * 10/1990 Pace ..... 62/372
5,011,034 A * 4/1991 Abel ..... 220/23.86
5,149,179 A * 9/1992 Nash ..... 312/275
5,197,603 A * 3/1993 Lundberg ..... 206/570
D338,303 S * 8/1993 Parente ..... D34/5
5,328,049 A * 7/1994 Ritzow ..... 220/315
5,538,338 A * 7/1996 Biggers ..... 312/319.9
5,540,012 A * 7/1996 Clegg ..... 49/70
5,558,254 A * 9/1996 Anderson ..... B65F 1/0053 220/23.86
5,641,090 A * 6/1997 Kowalski et al. ..... 220/782
6,564,992 B1 * 5/2003 Wegner ..... 229/117.35
6,596,983 B2 * 7/2003 Brent ..... 250/221
7,000,347 B2 * 2/2006 Roskin ..... 47/41.11
7,337,908 B2 * 3/2008 Dedmon ..... 206/600
7,654,443 B1 * 2/2010 Fuller et al. ..... 232/43.2
7,722,000 B2 * 5/2010 Sherburne ..... 248/27.8
8,083,091 B2 * 12/2011 Arteaga et al. ..... 220/646
8,348,081 B2 * 1/2013 Baptiste ..... 220/345.1
8,453,379 B1 * 6/2013 Kumar ..... 47/66.6
8,459,503 B2 * 6/2013 Groesbeck ..... 222/105
8,511,501 B2 * 8/2013 Onken et al. ..... 220/315
8,522,993 B2 * 9/2013 Flewelling ..... B65F 1/006 220/255
8,613,366 B2 * 12/2013 Finnestad et al. ..... 220/345.1
8,757,414 B2 * 6/2014 Roman et al. ..... 220/23.9
8,820,566 B2 * 9/2014 Ude ..... 220/367.1
8,839,553 B2 * 9/2014 Toro ..... 47/39
2003/0204990 A1 * 11/2003 Hsueh ..... 47/66.6
2004/0020927 A1 2/2004 Yang et al.
2005/0054085 A1 * 3/2005 Nagy et al. ..... 435/290.1
2005/0230407 A1 * 10/2005 Fang et al. ..... 220/908
2006/0213786 A1 * 9/2006 Walser ..... 206/216
2006/0226149 A1 10/2006 Yang et al.
2006/0261143 A1 * 11/2006 Sola Barbarin et al. .... 232/43.1
2009/0025289 A1 * 1/2009 Krieg ..... 47/66.6
2012/0261422 A1 * 10/2012 Matthews et al. ..... 220/495.01
2014/0345196 A1 * 11/2014 Lancaster, Jr. ..... 47/66.6

FOREIGN PATENT DOCUMENTS

DE 3233824 3/1984
DE 3233824 A1 * 3/1984 ..... B65F 1/16
DE 8509132 U1 3/1985
DE 9401923 U1 5/1994
DE 20008583 U1 9/2000
DE 10046409 A1 11/2001
DE 202005016813 2/2006
DE 202005016813 * 3/2006 ..... B65F 1/00
EP 0432306 A1 12/1989
EP 0706018 A2 10/1995
GB 2278989 A * 12/1994 ..... A01G 9/02
GB 2348111 9/2000
JP 08145567 A 6/1996
JP 2005112557 A 4/2005
WO WO 8706214 A1 * 10/1987 ..... B65F 1/10
WO WO 2008/048257 4/2008
WO WO 2008048257 * 4/2008 ..... G08B 17/10

OTHER PUBLICATIONS

GB Search Report, Application No. GB10147593, dated Apr. 28, 2011, 2 pages.
GB Examination Report, Application No. GB1014759.3, dated Oct. 31, 2014, 6 pages.
GB Examination Report, Application No. GB1014759.3, dated Apr. 28, 2015, 3 pages.

* cited by examiner

STORAGE HOUSING FOR A WASTE RECEPTACLE

CROSS-REFERENCE TO RELATED APPLICATIONS

The present application is a United States National Stage entry under 35 U.S.C. § 371 of International Application No. PCT/GB2011/051573, filed Aug. 19, 2011, designating the United States of America and published in English on Mar. 15, 2012, which in turn claims priority to Great Britain Patent Application No. 1014759.3 filed Sep. 6, 2010, both of which are incorporated herein by reference in their entirety.

The present invention relates to a storage housing for a waste receptacle and particularly, but not exclusively, to a storage housing for a so-called "wheelie bin".

It is known to position refuse sacks outside properties for collection and disposal by the local authorities. However, these refuse sacks are unsightly, attract vermin and often become broken by animals resulting in the spill of refuse therefrom. Accordingly, it is common for refuse sacks to be positioned in so-called "wheelie-bins", which serve to retain the waste until collection.

The wheelie-bins however can similarly detract from the visual appearance of a property and often produce unpleasant odours, owing to the storage of waste in a confined space. Moreover, it is common for wheelie-bins to become stolen, thereby necessitating the purchase of a further bin.

I have now devised a storage housing for a waste receptacle, which alleviates the above-mentioned problems.

In accordance with the present invention there is provided a storage housing for a waste receptacle, the housing comprising a base and side walls which extend from the base, and which terminate at an upper periphery thereof, at least one of the side walls comprising a door which can be opened and closed to enable the waste receptacle to be removably positioned within the housing through the at least one side wall, the housing further comprising locking means for releasably locking the door when closed and a lid which is moveable with respect to the side walls between a first position in which it substantially closes the housing and a second position in which it substantially opens the housing to enable waste to be deposited within the housing.

The storage housing thus enables a wheelie bin to be lockably secured therein, while also enabling waste to be deposited in the bin without having to remove the bin from the housing.

The locking means preferably comprises a key-operated lock or similar.

Preferably, the lid is arranged to accommodate plants. The lid is preferably tray-shaped and is arranged to hold soil and the like for growing plants. The lid preferably further comprises a drainage arrangement permitting excess water within the lid to drain from the lid.

Preferably, the lid is slidably mounted with respect to the side walls and is preferably lockable in the first position by further locking means.

Preferably, the housing comprises means for opening and closing the waste receptacle in accordance with the movement of the lid. The means for opening and closing the waste receptacle is preferably arranged to open the receptacle as the lid moves from the first position to the second position. The means for opening and closing the waste receptacle is preferably arranged to close the receptacle as the lid moves from the second position to the first position.

The means for opening and closing the waste receptacle preferably comprises a linkage which is securable at one end to the lid and at the other end to a cover of the waste receptacle.

Preferably, the housing further comprises means for stabilising the housing. The stabilising means preferably comprises an anchor which is arranged to pass into the ground. Alternatively, or in addition thereto, the stabilising means may comprise or further comprise brackets enabling the housing to be secured to a wall or similar.

The housing preferably further comprises means for dispensing a scent into the housing. Preferably, the means for dispensing a scent comprises a spray gun which is arranged to dispense the scent into the housing.

Preferably, the housing comprises a sensor for sensing movement of the lid. The means for dispensing scent is arranged to dispense scent in accordance with the sensed movement of the lid.

The housing preferably further comprises illumination means for illuminating the waste receptacle. Preferably, the housing further comprises an ambient light sensor for sensing the levels of ambient light and a motion sensor for sensing the presence of a user. The illuminating means is preferably arranged to operate in dependence of signals received from the light sensor and the motion sensor, such that when the light sensor senses that the light levels are below a threshold level and the motion sensor senses the presence of a user, the illuminating means is arranged to illuminate the waste receptacle.

An embodiment of the present invention will now be described by way of example only and with reference to the accompanying drawings, in which.

Figure 1:
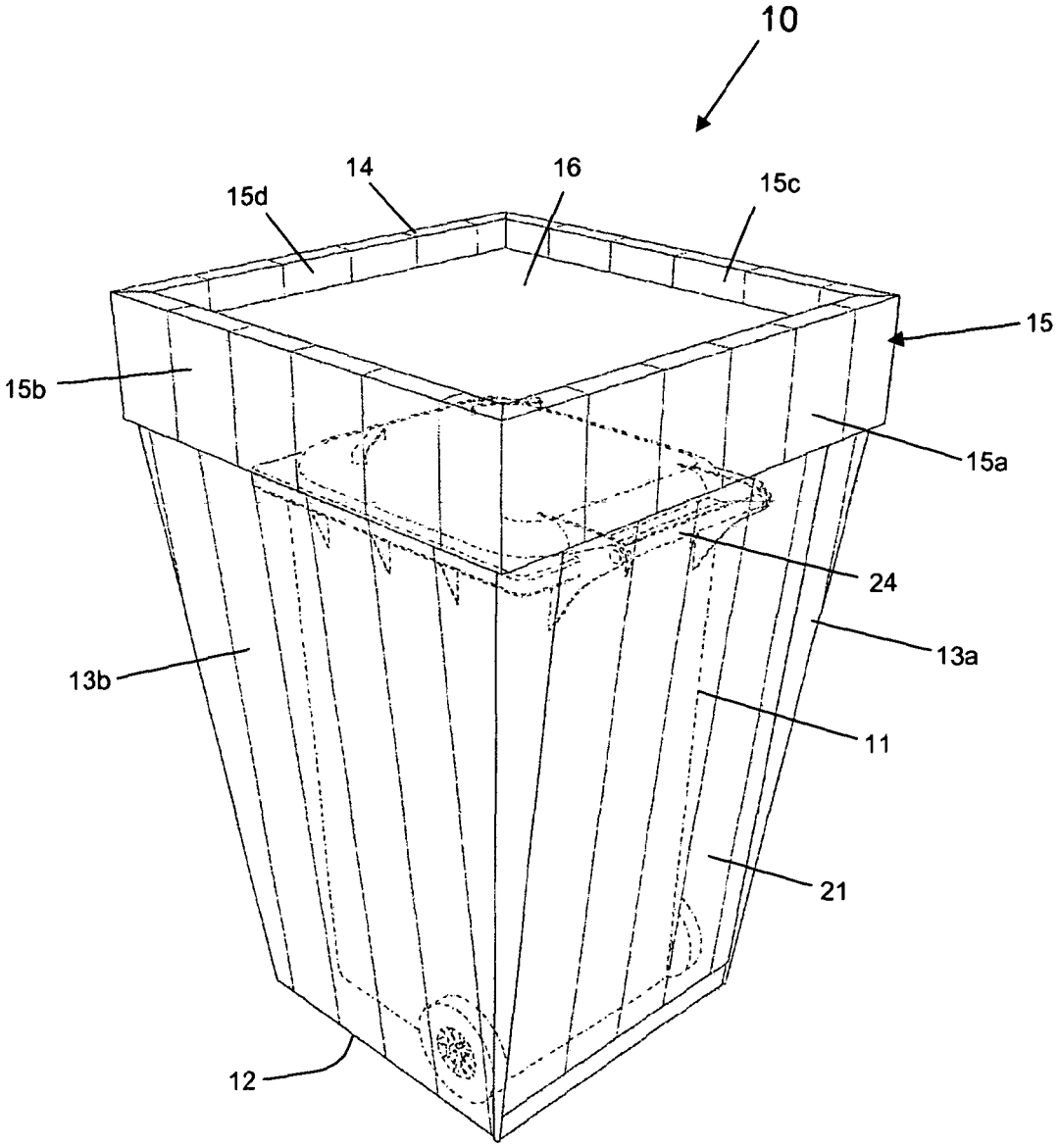
FIG. 1 is a perspective view of the storage housing according to an embodiment of the present invention, with a wheelie bin positioned therein.
Figure 2:
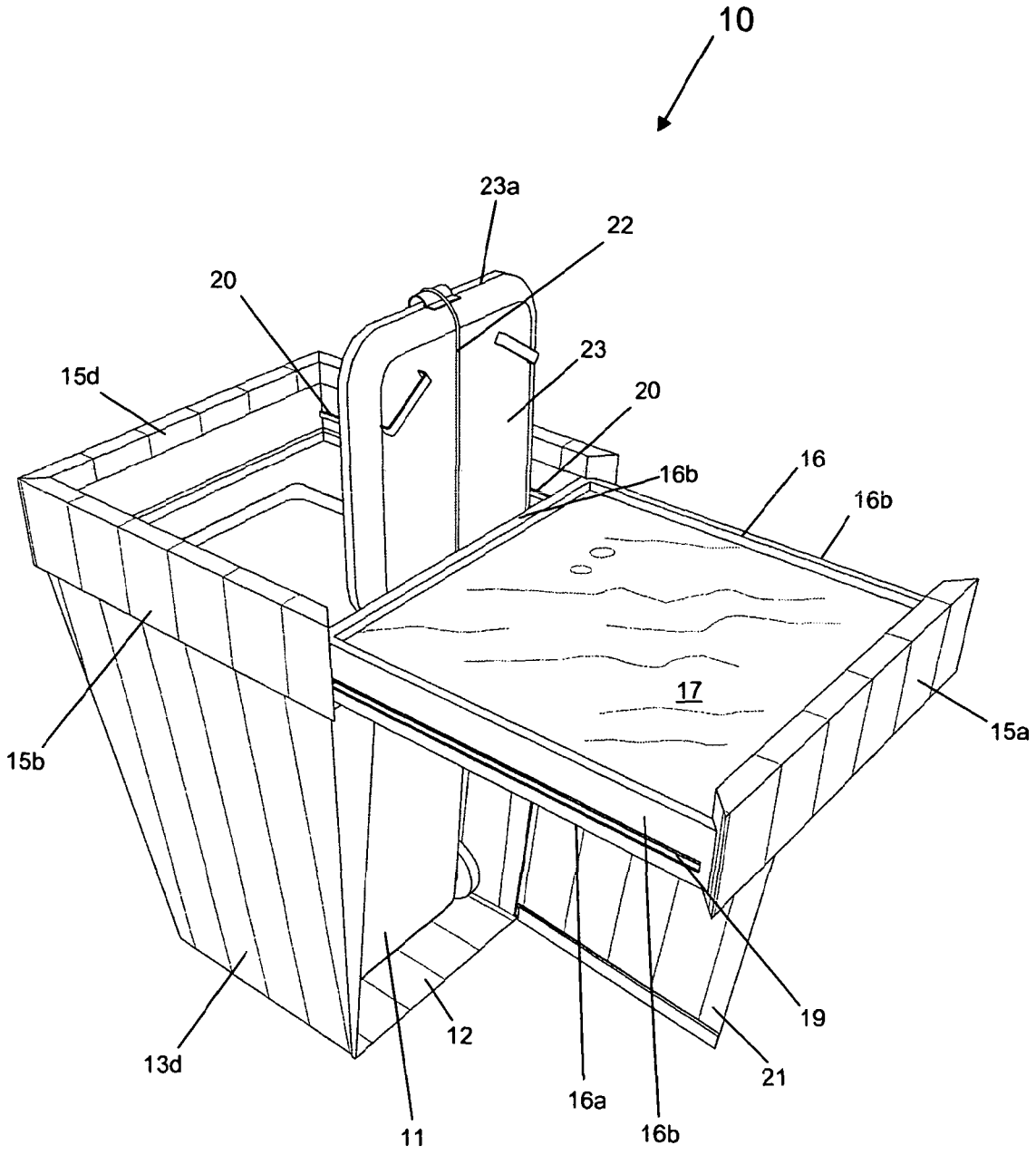
FIG. 2 is a perspective view of the storage housing illustrated in FIG. 1, with the lid and door opened.

Referring to FIGS. 1 and 2 of the drawings, there is illustrated a storage housing 10 for a waste receptacle, such as a waste refuse sack or a wheelie bin 11, according to an embodiment of the present invention.

The storage housing 10 comprises a substantially square base 12, and side walls 13*a-d* which extend from the periphery of the base 12 and which diverge away from each other toward an open upper periphery 14 of the housing 10. The upper periphery 14 of the housing 10 comprises a collar 15 having a first, second, third and fourth collar panel 15*a-d*, which separately extend along the upper region of each side wall 13*a-d*. The housing 10 further comprises a lid 16 which is moveable within the collar 15 to open and close the housing 10 at the upper region thereof.

The lid 16 comprises a bottom section 16*a* and upstanding side walls 16*b* which extend from the periphery of the bottom section 16*a*, to form a substantially tray-like shape. The lid 16 is arranged to accommodate soil and compost 17 and the like for enabling plants 18 to grow therein. The lid 16 further comprises a drainage arrangement (not shown) comprising a plurality of drainage holes (not shown) disposed in the bottom section 16*a* thereof, to enable excess water within the lid 16 to drain therefrom. The drainage arrangement (not shown) may further comprise a ducting arrangement (not shown) for collecting water that passes through the drainage holes (not shown) and for passing the water out from the housing 10.

The lid 16 further comprises a runner 19 (only one of which is illustrated in the drawings) disposed in two opposing side walls 16*b*, which are separately arranged to cooperate with a track 20 disposed in two opposing collar panels, for example the second and third collar panel 15*b*, 15*c*. The runners 19 and tracks 20 are arranged to enable the lid 16 to slide into and out from the collar 15 of the housing 10 to open and close the housing, and thus permit waste (not shown) to be deposited in a waste receptacle, such as a wheelie bin 11 positioned within the housing 10. In this respect, one of the collar panels, for example a first collar panel 15*a* which extends between the second and third opposing collar panels 15*b*, 15*c*, forms one of the upstanding side walls 16*b* of the lid 16 or is otherwise secured to one of the side walls 16*b* of the lid 16. The lid further comprises locking means such as a key-operated lock (not shown), for locking the lid when closed.

The housing 10 further comprises a door 21 disposed in one of the side walls 13*a* thereof, which permits the waste receptacle, such as a wheelie bin 11, to be removably positioned within the housing 10. The door 21 is arranged in the housing 10 at the side from which the lid 16 is arranged to extend, and is hingedly coupled along one side edge thereof to the side wall 13*a*, such that the door 21 can be rotated to open and close the side wall 13*a* of the housing 10. The door 21 further comprises a lock (not shown), such as a padlock, for locking the door 21 in the closed configuration and to thus minimise potential theft of the bin 11.

The housing 10 further comprises a linkage, such as a tether 22, which is securable at one end to the lid 16 and at the other end to a cover 23 of the wheelie bin 11. The cover 23 is hingedly coupled to the bin 11 at hinge 24 and the tether 22 is securable to the cover 23 at the free side 23*a* thereof which is opposite the hinge 24. In this manner, when the bin 11 is positioned within the housing 10 and the linkage 22 suitably coupled to the cover 23 and lid 16, then as the lid 16 is moved to open the housing 10, the cover 23 is arranged to pivot about the hinge 24 to open the bin 11.

The housing 10 further comprises a scent dispenser, such as a spray gun (not shown) or deodorising canister (not shown), disposed therein for releasing an aromatic scent to suppress any unpleasant odours which emanate from the bin 11 and/or refuse sacks positioned within the housing 10. The scent dispenser (not shown) may be manipulated by a user (not shown) to dispense the scent as required. Alternatively, or in addition thereto, the scent dispenser (not shown) may be arranged to dispense scent in accordance with the movement of the lid 16. In this embodiment, it is envisaged that the housing 10 may comprise a sensor (not shown) disposed upon the housing 10 to sense movement of the lid 16, such that as the lid 16 moves to the open position, the sensor (not shown) is arranged to cause the scent dispenser (not shown) to dispense scent into the housing 10.

The housing further comprises a light (not shown) or similar disposed upon the lid 16 for illuminating the waste receptacle 11 when depositing waste therein at night for example. The light (not shown) is arranged to operate in dependence of signals received from an ambient light sensor (not shown) and a motion sensor (not shown), such that when the light sensor (not shown) senses that the levels of ambient light have reduced to a level below a threshold value and the motion sensor (not shown) senses the presence of a user (not shown), the light (not shown) is arranged to illuminate to assist the user in depositing waste. Once the sensor detects the absence of the user, namely no motion, or after a pre-determined time lapse, the light (not shown) is then arranged to switch off.

Figure 3:
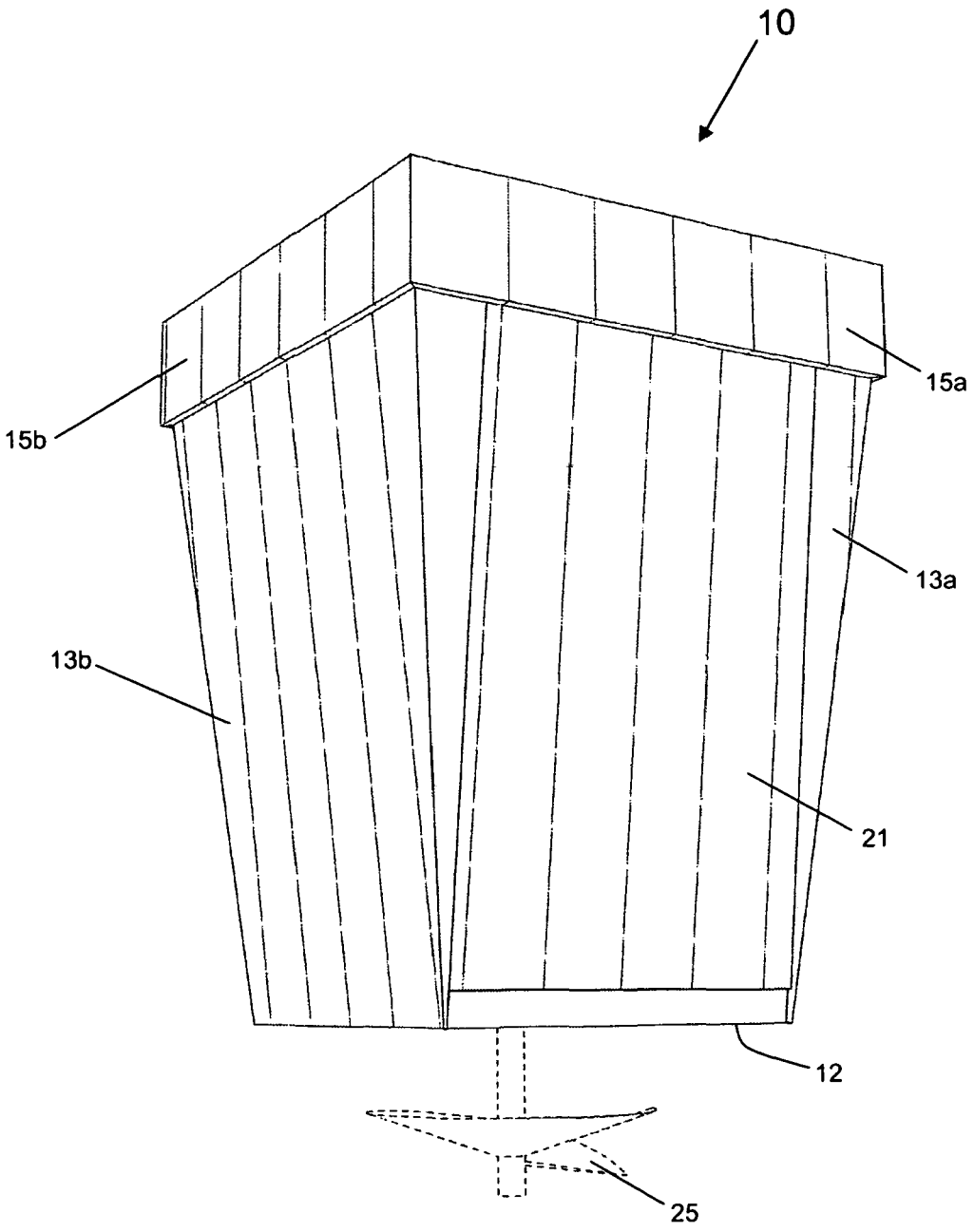
FIG. 3 is a perspective view of the storage housing illustrated in FIG. 1, illustrating an anchor for stabilising the housing; and, FIG. 4 is a perspective view of the storage housing illustrated in FIG. 1, with plants positioned within the lid.

Referring to FIG. 3 of the drawings, the housing 10 further comprises an anchor 25, disposed at the underside of the base 12, which may be in the form of a screw for example, and which is arranged to extend into the ground. It is found that when the lid 16 is moved to open the housing 10, the weight of the lid 16 and any soil 17 and plants 18 disposed therein, can cause the housing 10 to topple over. The anchor 25 is thus arranged to stabilise the housing 10 and maintain the housing 10 in a suitable upright orientation. If required, the housing 10 may be further stabilised using brackets (not shown) disposed on the side walls 13 of the housing 10. The brackets (not shown) permit the housing 10 to be coupled directly to a wall (not shown) by passing fasteners (not shown), for example screws, through the brackets (not shown) into the wall (not shown).

Figure 4:
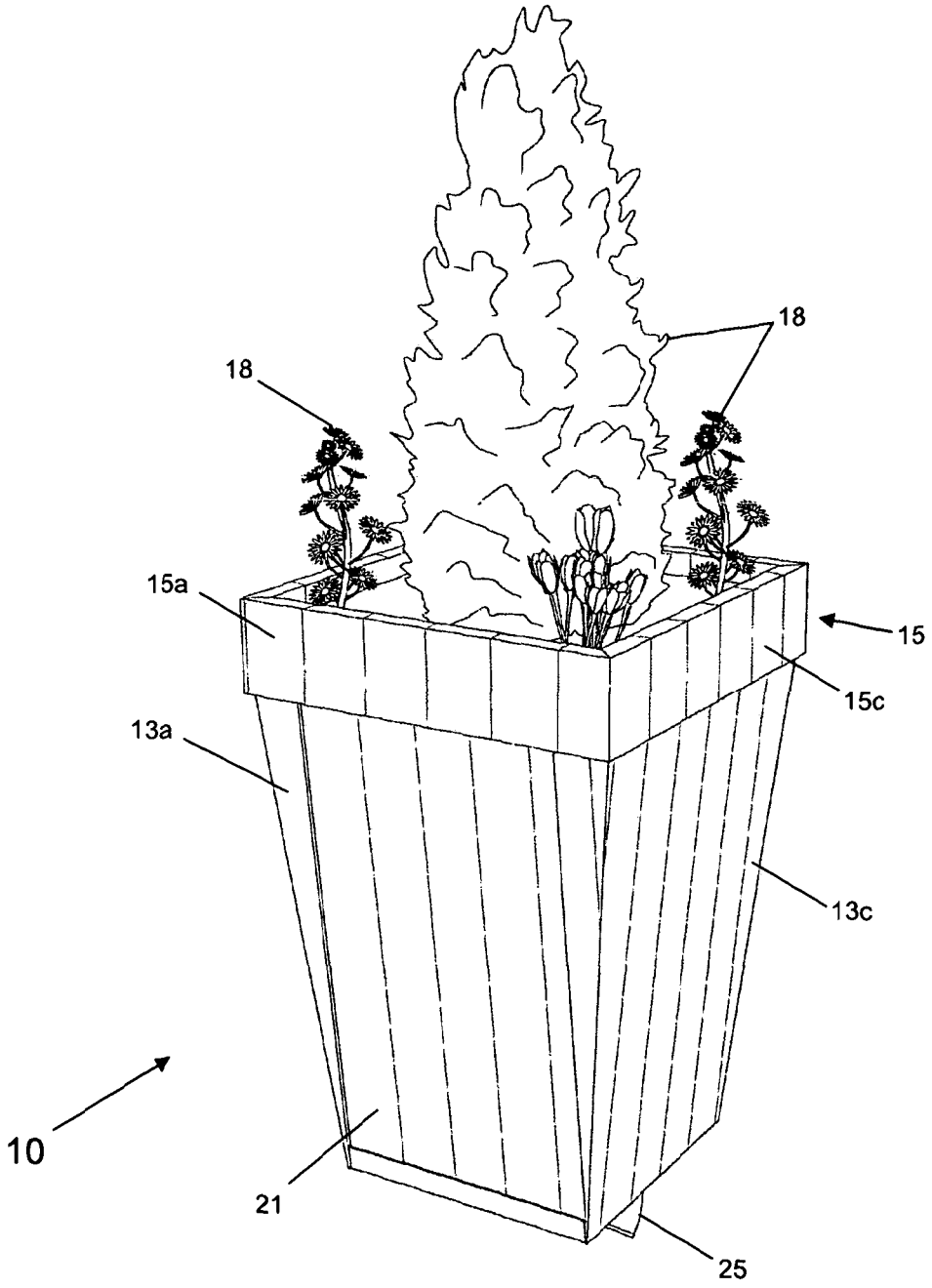

In use, a user (not shown) first stabilises the housing 10 by forcing the anchor 25 into the ground and/or by using the brackets (not shown). The user (not shown) may then fill the lid 16 with soil and compost 17, for example and then position plants 18 within the soil 17 to provide for an attractive feature, as illustrated in FIG. 4 of the drawings. The plants 18 are found to further provide an aromatic scent which helps suppress any unpleasant odours. The user (not shown) subsequently opens the door 21, wheels the bin 11 into the housing 10 and then locks the door 21 in the closed configuration to securely house the bin 11, and thus remove the bin from view.

The lid 16 is then unlocked and moved to open the housing 10 and expose the cover 23 to the bin 11, and the tether 22 is coupled at one end to the free side 23*a* of the cover 23 and at the other end to the lid 16, such that when the lid 16 is subsequently moved from the closed position to the open position, the tether 22 causes the cover 23 to move to open the bin 11 and thus enable a user (not shown) to deposit waste within the bin 11. Simultaneously, the movement of the lid is sensed by the sensor (not shown), which causes the scent dispenser (not shown) to dispense an aromatic scent into the housing 10 and thus suppress any unpleasant odours which emanate therefrom. If required, the user (not shown) may dispense further scent by manipulating the scent dispenser (not shown). The user may then close the lid 16 and lock the lid 16 in the closed configuration to secure the housing.

Once the bin 11 has been suitably filled, the lid 16 is unlocked and moved to the open position to expose the tether 22, which is then uncoupled from the free side 23*a* of the cover 23. The door 21 is then unlocked and opened to enable the bin 11 to be removed for emptying.

What is claimed is:

1. An assembly comprising a storage housing and a wheeled waste receptacle contained within the housing, the housing comprising front, rear and opposite side walls which extend from a base, and which terminate at an upper periphery of the housing thereof, at least the front side wall comprising a door which can be opened and closed relative to the side wall to enable the waste receptacle to be removably positioned within and removed from the housing through the front side wall;

the housing further comprising locking means for releasably locking the door when closed and a lid slidably mounted with respect to said opposite side walls which is slidably moveable in a horizontal direction with respect to the front side wall between a first position in which the lid substantially closes the housing and a second position in which the lid substantially opens the housing;

the waste receptacle comprising a hinged cover and the housing comprising a linkage between the hinged cover and the lid of the housing, wherein the linkage hinges the cover of the waste receptacle as the lid is slid horizontally forwardly from said first to said second position to open the cover of the waste receptacle and to enable waste to be deposited within the open receptacle, the housing being arranged to close the cover of the waste receptacle as the lid is slid horizontally rearwardly from said second to said first position.

2. An assembly according to claim 1, wherein the locking means comprises a key-operated lock.

3. An assembly according to claim 1, wherein the lid is arranged to accommodate plants.

4. An assembly according to claim 1, wherein the lid is tray-shaped and is arranged to hold soil and the like for growing plants.

5. An assembly according to claim 3, wherein the lid further comprises a drainage arrangement permitting excess water within the lid to drain from the lid.

6. An assembly according to claim 1, wherein the lid is lockable in the first position by further locking means.

7. An assembly according to claim 1, further comprising a stabilizer for stabilising the housing.

8. An assembly according to claim 7, wherein the stabilizer comprises an anchor which is arranged to pass into the ground.

9. An assembly according to claim 7, wherein the stabilizer comprises brackets enabling the housing to be secured to a wall or ground or similar.

10. An assembly according to claim 1, further comprising a dispenser for dispensing a scent into the housing.

11. An assembly according to claim 10, wherein the dispenser comprises a spray gun which is arranged to dispense the scent into the housing.

12. An assembly according to claim 1, wherein the housing comprises a sensor for sensing movement of the lid.

13. An assembly according to claim 12, further comprising a dispenser for dispensing a scent into the housing, wherein the dispenser scent is arranged to dispense scent in accordance with the sensed movement of the lid.

14. An assembly according to claim 1, further comprising an illumination source for illuminating the waste receptacle.

15. An assembly according to claim 14, further comprising an ambient light sensor for sensing the levels of ambient light and a motion sensor for sensing the presence of a user.

16. An assembly according to claim 15, wherein the illumination source is arranged to operate in dependence of signals received from the light sensor and the motion sensor, such that when the light sensor senses that the light levels are below a threshold level and the motion sensor senses the presence of a user, the illumination source being arranged to illuminate the waste receptacle.

* * * * *